United States Patent [19]

Goodspeed

[11] Patent Number: 4,883,294

[45] Date of Patent: Nov. 28, 1989

[54] TAMPER-PROOF LOCKING DEVICE

[76] Inventor: Byron L. Goodspeed, 1111 Holcomb Rd., Kelso, Wash. 98626

[21] Appl. No.: 194,333

[22] Filed: May 16, 1988

[51] Int. Cl.[4] ..... E05C 1/04

[52] U.S. Cl. ..... 292/148; 70/56; 70/129; 70/417

[58] Field of Search ..... 70/129, 54–56, 70/417, 451; 292/148, 205, 337

[56] References Cited

U.S. PATENT DOCUMENTS

| | | | |
|---|---|---|---|
| 1,047,315 | 12/1912 | Shone | 292/148 X |
| 1,219,488 | 3/1917 | Rompf | 292/148 X |
| 1,446,085 | 2/1923 | Falk | 70/451 |
| 1,446,589 | 2/1923 | Shaw | 70/417 |
| 2,117,715 | 5/1938 | Godfried | 70/417 |
| 2,613,970 | 10/1952 | Holmsten | 292/148 |
| 2,766,605 | 10/1956 | O'Brien | 70/417 |
| 2,974,987 | 3/1961 | O'Brien | 292/148 |
| 2,986,919 | 6/1961 | Hensel | 70/451 |
| 3,094,861 | 6/1963 | Sayles | 292/148 X |
| 3,334,933 | 8/1967 | Ehlers | 292/148 |
| 3,347,581 | 10/1967 | Hann | 292/337 |
| 3,606,423 | 9/1971 | McCarthy | 70/55 |
| 4,021,063 | 5/1977 | Porter | 292/148 X |
| 4,095,828 | 6/1978 | East | 292/148 |
| 4,185,860 | 1/1980 | Bondi | 292/148 |
| 4,214,783 | 7/1980 | Boegeman | 292/148 X |
| 4,234,220 | 11/1980 | Finch et al. | 292/148 |
| 4,307,904 | 12/1981 | Daus | 292/148 |
| 4,613,175 | 9/1986 | Nelson | 292/148 |
| 4,798,065 | 1/1989 | DeForrest, Sr. | 70/129 |

*Primary Examiner*—Lloyd A. Gall

*Attorney, Agent, or Firm*—Dellett, Smith-Hill & Bedell

[57] ABSTRACT

A locking device for use in connection with a separate padlock provides improved security against unauthorized tampering. The device is an enclosure for the padlock and a deadbolt, the deadbolt being slidable within the enclosure. The padlock is suspended from the deadbolt and engages a notch in the deadbolt to restrict longitudinal movement of the deadbolt while the deadbolt is extended from the enclosure and engaged within a keeper external of the enclosure.

4 Claims, 7 Drawing Sheets

TAMPER-PROOF LOCKING DEVICE

BACKGROUND OF THE INVENTION

It is often desirable to provide a locking mechanism adapted to operate in connection with a separate padlock. For example, a mini-storage enclosure includes a locking assembly which is secured by a padlock supplied by the user of the mini-storage enclosure to insure that the user has the only authorized means of access to the enclosure. Key features of such a locking assembly include adequate protection for the padlock against cutting of the shackle or striking the padlock to release it from its locking position, protection of the tongue or deadbolt against prying, and protection from weather conditions which might deteriorate the padlock mechanism.

U.S. Pat. No. 3,606,423 (McCarthy) discloses a locking device which includes an enclosure having a pathway for a tongue which is affixed to a closure member, such as the top of a chest, and positioned to enter the pathway as the chest top is closed. A padlock is positioned within the enclosure and, in its unlocked condition, receives the distal end of the tongue as the chest top is closed. When locked, the padlock body engages a notched portion of the tongue to secure the tongue within the enclosure and thereby lock the chest, the padlock being held against movement in directions parallel to the movement of the tongue in the pathway. It is necessary to hand place the padlock within the enclosure, in position to receive the tongue, every time the chest is to be locked. It is not clear how such a device could be utilized for locking, for example, a door where it would be desirable to avoid attaching the tongue to the door, it being desirable to permit tongue movement independent of the door and in directions other than the direction of door movement. Further, the device does not have a low profile with respect to the surrounding surfaces so as to make it more difficult to strike and dislodge the device from its mounting surface. The tongue of described device is not disposed closely to the surrounding surfaces and could be breached by prying it away from the surrounding surface. Modification to the door and surrounding wall would be necessary to avoid such pry points.

SUMMARY OF THE INVENTION

A locking device, in accordance with a principal embodiment of the present invention, is used in connection with a padlock having a body and a shackle, wherein the shackle may be brought into locking engagement with the body, and includes an elongate deadbolt having a portion thereof adapted to fit within the shackle of the padlock such that the deadbolt may translate along its longitudinal axis with respect to the padlock when the shackle is not in locking engagement with the body and is held substantially stationary with respect to the padlock when the shackle is in locking engagement with the body. An enclosure is adapted to slidably support the deadbolt to allow longitudinal translation thereof while holding the padlock stationary in directions parallel to the longitudinal axis of said deadbolt. The deadbolt extends in its longitudinal direction beyond the enclosure and is received within a keeper which only permits longitudinal movement of the deadbolt therein. The enclosure may, for example, be mounted on a door to be secured and the keeper may be mounted on the door jamb in position to receive the deadbolt.

According to one aspect of the present invention, the locking device may be constructed with a relatively low profile so as to be as flush as possible to the wall. The deadbolt is flat stock and carried very close to the door and wall surfaces without allowing for a pry point between the deadbolt and the door or wall.

According to a second aspect of the present invention, the padlock does not have to be hand placed in the enclosure every time the locking device is to be used. The deadbolt and padlock remain within the enclosure and the deadbolt remains within the shackle of the padlock whether or not the shackle is locked. Thus, the deadbolt may be engaged in the keeper to secure the door without the padlock being locked, thereby preventing entry from one side of the door while permitting entry from the opposite side.

According to another aspect of the present invention, a roller bar is rotationally disposed within a deadbolt such that during an attempt to saw through the deadbolt, a saw blade will rotate the roller bar rather than saw through the roller bar, thereby preventing the cutting of the deadbolt.

Accordingly, it is an object of the present invention to provide an improved locking device.

The subject matter of the present invention is particularly pointed out and distinctly claimed in the concluding portion of this specification. However, both the organization and method of operation, together with further advantages and objects thereof, may best be understood by reference to the following description taken in connection with accompanying drawings wherein like reference characters refer to like elements.

DRAWINGS

DETAILED DESCRIPTION

Figure 1:
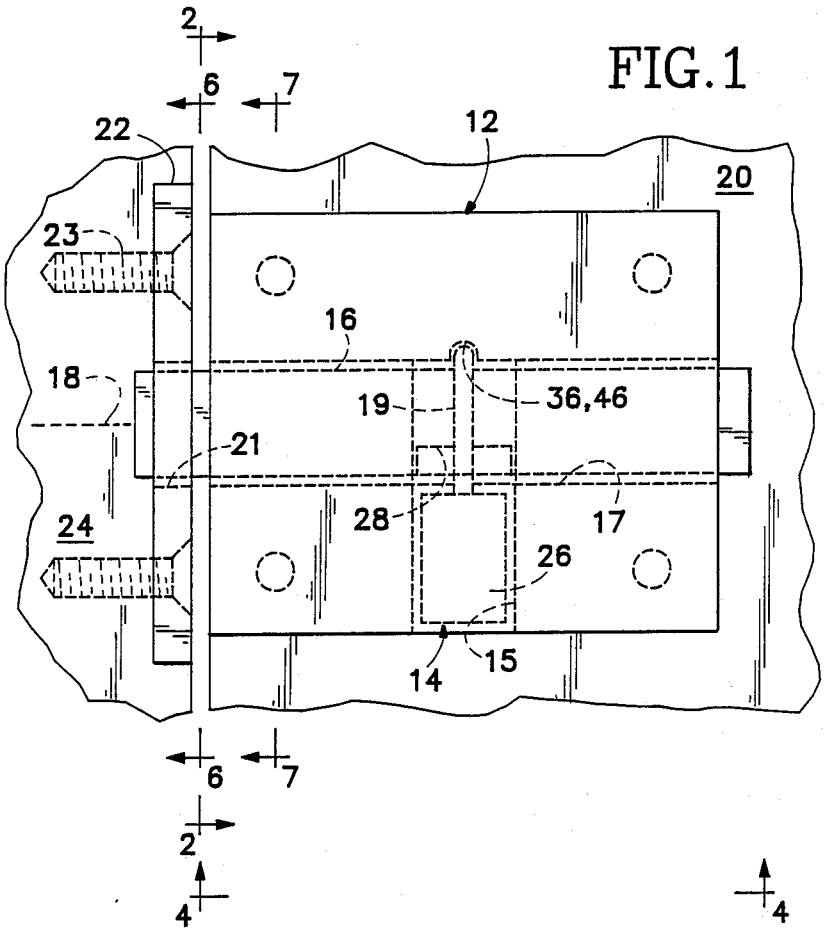
FIG. 1 illustrates, as a preferred embodiment of the present invention, a tamper-proof locking device and a padlock suitable for use in connection therewith.
Figure 3:
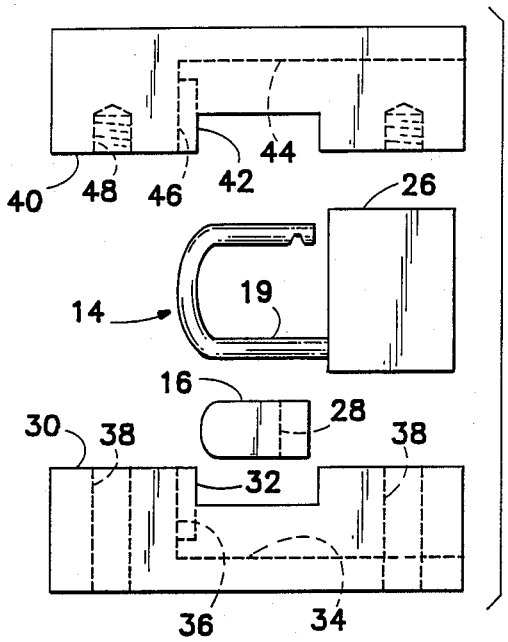
FIG. 3 is an exploded end view of the device of FIG. 1.
Figure 2:
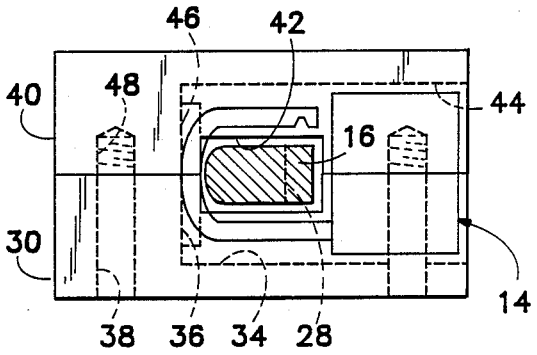
FIG. 2 is an end view of the device of FIG. 1 taken along lines 2—2 of FIG. 1.
Figure 4:
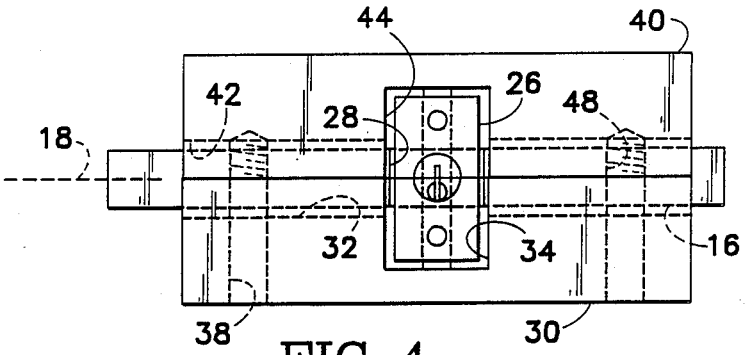
FIG. 4 is a side view of the device of FIG. 1 taken along lines 4—4 of FIG. 1.
Figure 5:
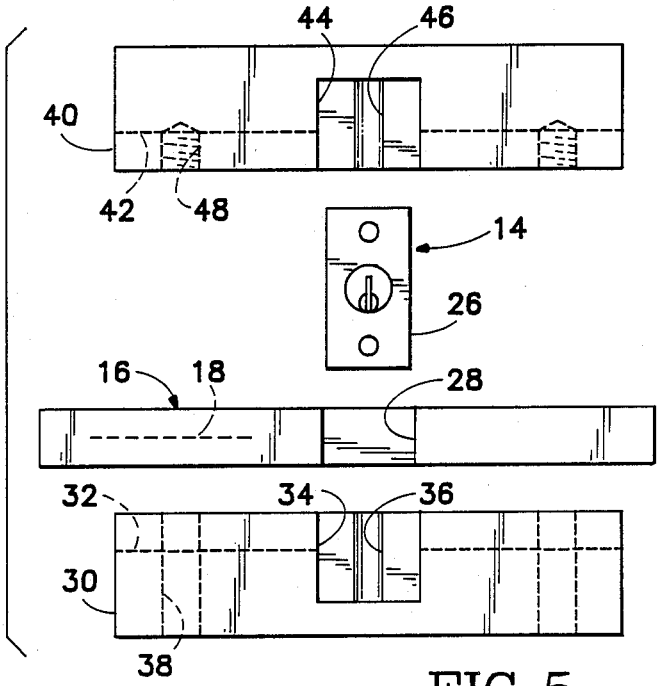
FIG. 5 is an exploded side view of the device of FIG. 1.

In FIG. 1 a locking device 12, in accordance with a preferred embodiment of the present invention, is shown with a padlock 14, held within pathway 15 and suspended from slidable deadbolt 16. When padlock 14 is disengaged from its locking position, deadbolt 16 slides within pathway 17 along its longitudinal axis 18, transverse to pathway 15. Padlock 14 is held against movement in directions parallel to axis 18 by pathway 15 and is suspended from deadbolt 16 by shackle 19. Locking device 12 is mounted on door 20 and keeper 22 is mounted on door jamb 24 such that keeper hole 21 is in position to receive deadbolt 16 when door 20 is in its closed position. Deadbolt 16 is extended from locking device 12 and is received within keeper 22 in order to secure door 20 in its closed position. Deadbolt 16 is locked in this extended position by engaging the locking mechanism of padlock 14 such that padlock body 26 is disposed within notch 28 of deadbolt 16. In this condition padlock 14 is protected from unauthorized access such as by cutting shackle 19 or by striking padlock body 26. Padlock 14 is also protected within the enclosure of locking device 12 from weather elements. Padlock 14 is installed in locking device 12 by sliding deadbolt 16 out of pathway 17 and inserting padlock 14 within pathway 15, in its unlocked state, to allow deadbolt 16 to be returned to pathway 17 and placed within shackle 19 of padlock 14.

Referring now to FIGS. 2–5, locking device 12 includes a base plate 30 and a top plate 40, each having channels forming pathways 15 and 17 when base plate 30 and top plate 40 are brought together. Base plate 30 has a channel 32 dimensioned to slidably support deadbolt 16 and allow translation thereof along axis 18. A channel 34 intersects channel 32 and is dimensioned to receive padlock 14 therein and hold it against movement in directions parallel to axis 18 while allowing movement perpendicular to axis 18. A groove 36 at an upper end of channel 34 and adjacent to an upper side of channel 32 is provided for receiving the bight of shackle 19 such that shackle 19 does not obstruct pathway 15 when padlock 14 is suspended from deadbolt 16. Apertures 38 in base plate 30 receive mounting bolts therethrough for securing device 12 to a surface.

Top plate 40 is shown with a channel 42 and channel 44 for receiving deadbolt 16 and padlock 14, respectively. Channels 32 and 42 form pathway 17 while channels 34 and 44 form pathway 15. Top plate 40 also includes a groove 46 similar to groove 36 of base plate 30. Insofar as these channels and grooves are concerned, top plate 40 and base plate 30 are substantially identical in structure and dimension. However, top plate 40 differs from base plate 30 with respect to its mounting means. Top plate 40 includes threaded apertures 48, extending partially through top plate 40, for threadably receiving mounting bolts.

Figure 6:
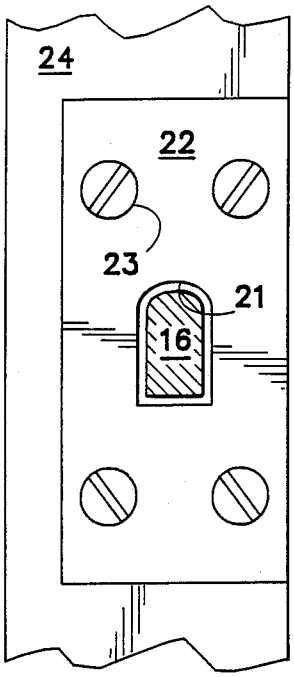
FIG. 6 is a sectional view of the device of FIG. 1 taken along lines 6—6 of FIG. 1.

FIG. 6 shows the face of keeper 22 and how it may be mounted to door jamb 24, viz. screws 23. In the particular embodiment shown, keeper 22 is inset in door jamb 24 in a position to receive deadbolt 16 in keeper hole 21 while allowing room for door 20 to close. It is understood that keeper 22 may take many forms and be mounted in many ways so long as keeper hole 21 is positioned to receive deadbolt 16 and permit only longitudinal movement thereof when inserted in keeper hole 21. In this regard, keeper hole 21 should be of similar cross-sectional shape to deadbolt 16 which includes a rounded portion to accommodate a close fit within the inner bight portion of shackle 19.

Figure 7:
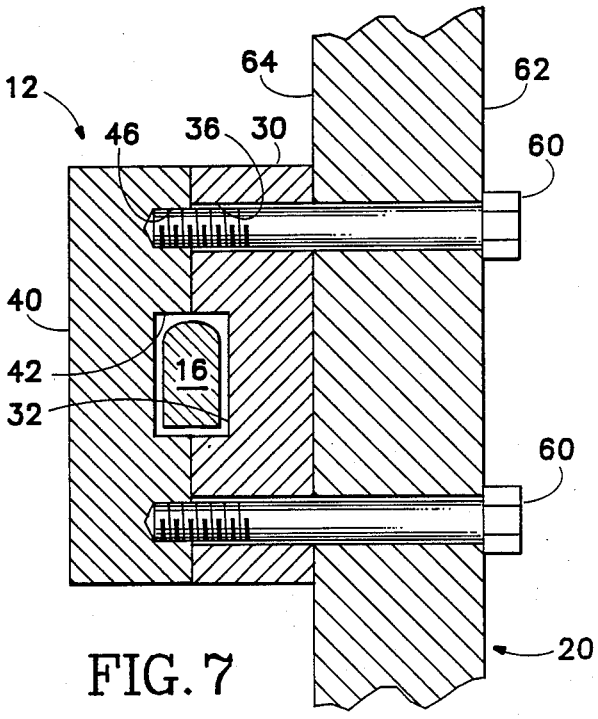
FIG. 7 is a sectional view of the device of FIG. 1 taken along lines 7—7 of FIG. 1.

In FIG. 7, mounting bolts 60 extend through door 20 with their bolt heads resting against an inside surface 62 of door 20 and their threaded ends extending beyond an outside surface 64 of door 20. Base plate 30 is positioned upon surface 64 with bolts 60 extending through apertures 36 and slightly beyond base plate 30. Top plate 40 is placed against base plate 30 and bolts 60 are threaded within threaded apertures 48 and tightened to secure the entire assembly upon door 20. It may be appreciated that the bolt heads of bolts 60 are only exposed on the inside surface 62 of door 20 and from the outside surface 64 of door 20, device 12 has a low profile with respect to surface 64 and would be difficult to strike or pry.

Figure 9:
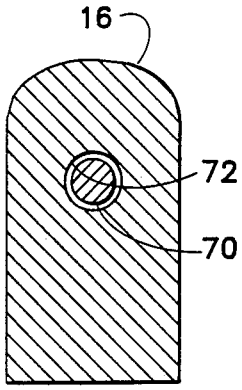
FIG. 9 is a cross-sectional end view of the deadbolt of FIG. 8 taken along line 9—9 of FIG. 8.
Figure 8:
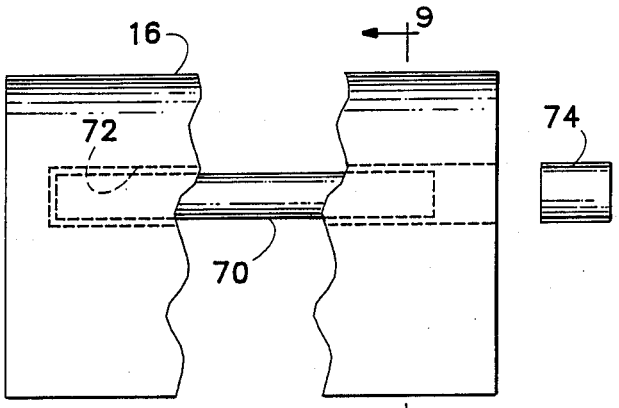
FIG. 8 is a partially cut away side view of a deadbolt utilizing a roller bar for preventing sawing through the deadbolt.

Referring to FIGS. 8 and 9, to further enhance the security of locking device 12, roller bar 70 is disposed rotationally within longitudinal bore 72 of deadbolt 16. Plug 74 is inserted within the open end of bore 72 and may be welded therein to seal bore 74 and thereby secure bar 70 within deadbolt 16. If an attempt is made to saw through deadbolt 16, a saw blade encountering roller bar 70 would rotate bar 70 rather than saw through it, and the attempt would fail. It may be appreciated that roller bar 70 could be used in conjunction with a variety of locking devices beyond the construction described herein.

Figure 10:
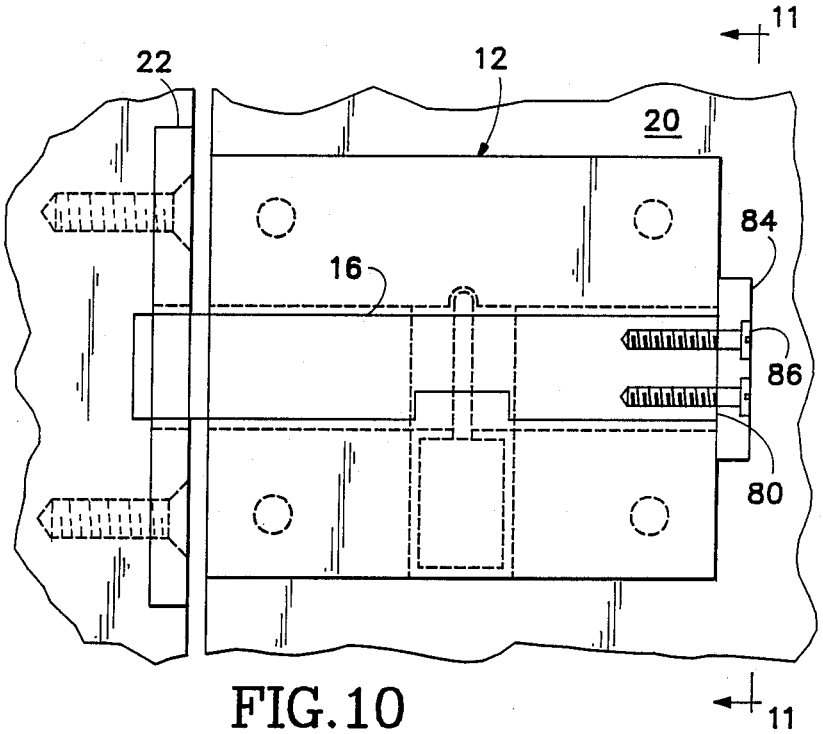
FIGS. 10 and 11 show modifications for enhancing the security of the device of FIG. 1.
Figure 11:
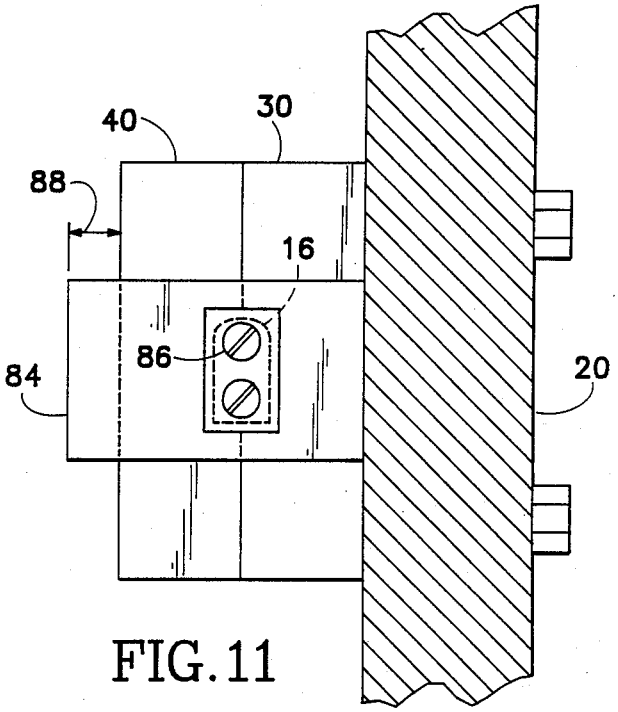

In FIG. 1, the end of deadbolt 16 opposite keeper 22 extends beyond plates 30 and 40 when the deadbolt 16 is in its locked position, thereby providing a means for grasping deadbolt 16 and sliding the same within pathway 17 to remove it from the keeper 22. However, the exposed end of the deadbolt offers an opportunity to pry deadbolt 16 away from door 20, there being a space between the deadbolt and the door. Referring now to FIGS. 10 and 11, as an additional precaution to prevent prying of device 12 away from door 20, a plate 84 is affixed by screws 86 to the exposed end of deadbolt 16 opposite keeper 22 and spans the space between deadbolt 16 and the door. The end of deadbolt 16 opposite keeper 22 is flush with the edge of plates 30 and 40 when deadbolt 16 is in its locked position. As seen in FIG. 11, plate 84 extends a distance 88 beyond the exterior face of the top plate to provide a means for grasping and moving deadbolt 16. However, prying or removal of plate 84 leaves the rest of the device intact.

Although the embodiment of device 12 as illustrated herein is constructed from machined parts, e.g. separate plates 30 and 40, it will be appreciated that the body of device 12 may suitably be cast as a single piece having pathways formed therein for accommodation of deadbolt 16 and padlock 14. As a casting, device 12 could occupy less space and would be better suited for applications where space limitations are restrictive.

Due to the symmetry of device 12, it will be appreciated that keeper 22 may be positioned at the left of device 12, as shown in FIG. 1, or removed in position to the right end of device 12. So configured, plate 84 would be positioned at the left end of the device.

Figure 12:
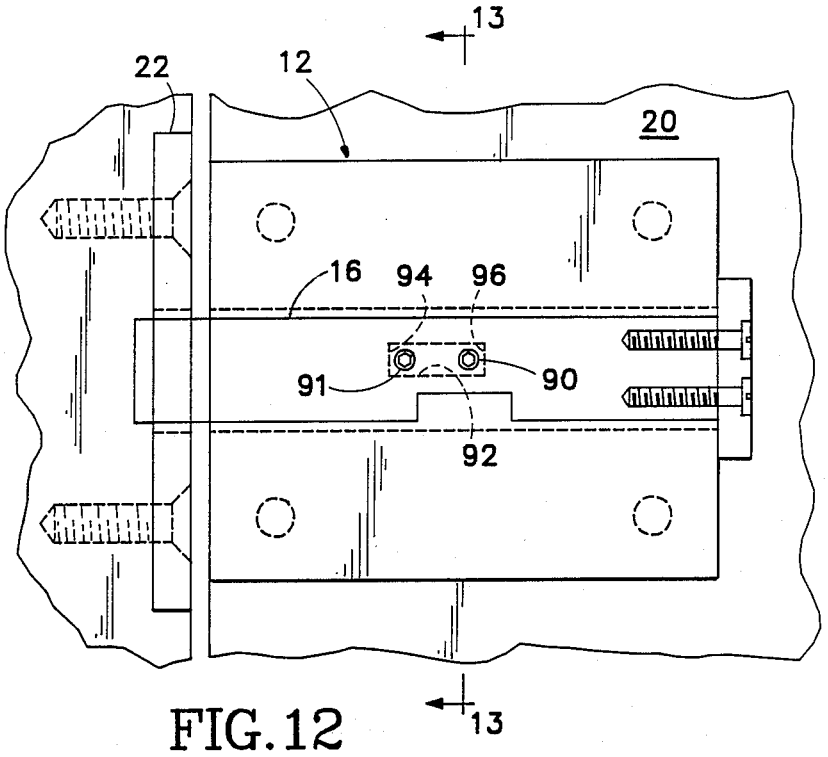
FIGS. 12 and 13 illustrate stops for preventing the deadbolt of the device of FIG. 1 from sliding out of the device when the padlock is unlocked.
Figure 13:
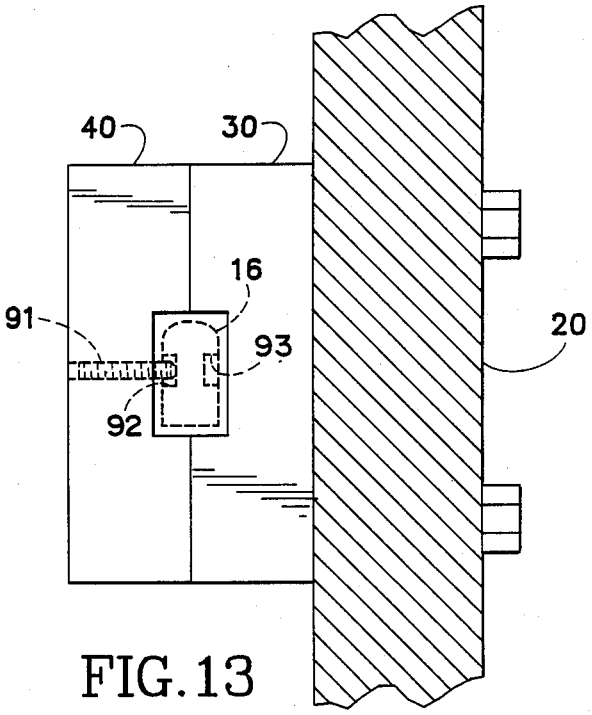

In FIGS. 12 and 13, right allen screw 90 and left allen screw 91 operate as stops for deadbolt 16, each being threaded within plate 40 and extendible into groove 92 in deadbolt 16. Groove 92 is centered along the length of deadbolt 16. When keeper 22 is positioned at the left of device 12 as shown, left allen screw 91 is removed from groove 92, but not necessarily from plate 40, and right allen screw 90 is extended into groove 92. When deadbolt 16 is moved to the right and disengaged from keeper 22, right allen screw 90 stops at left end 94 of groove 92 and prevents deadbolt 16 from sliding out of device 12. In a similar manner, if keeper 22 were positioned to the right of device 12, right allen screw 90 is backed off from deadbolt 16 and left allen screw 91 is threaded into groove 92. When deadbolt 16 is moved to the left and disengaged from keeper 22, left allen screw 91 stops at an end of groove 92 and prevents deadbolt 16 from sliding out the left end of device 12. Alternatively, the deadbolt 16 may be turned over, and a groove 93 utilized. While screws 90 and 91 are shown as being accessed from the outer face of device 12, i.e., threaded within top plate 40, it will be appreciated that screws 90 and 91 could be positioned at various locations on device 12 so long as they are threaded within a stationary portion of device 12 to engage a groove formed within deadbolt 16. For example, if device 12 were cast as a single piece, as discussed previously herein, screws 90 and 91 may be threaded within the casting above deadbolt 16 and only one groove would be required in deadbolt 16.

Thus, the present invention provides an improved locking device which is less susceptible of tampering than those found in the prior art. A low profile and an absence of pry points make the locking device particularly difficult to strike or pry from its mounting position, and a roller bar within the deadbolt prevents sawing of the deadbolt. Also, once a padlock is installed, it is unnecessary to hand position the padlock within the device every time the deadbolt is disengaged from the keeper.

While a preferred embodiment of the present invention has been shown and described, it will be apparent to those skilled in the art that many changes and modifications may be made without departing from the invention in its broader aspects. The appended claims are therefore intended to cover all such changes and modifications as fall within the true spirit and scope of the invention.

I claim:

1. A device used in connection with a padlock having a body and a shackle wherein the shackle may be brought into locking engagement with the body, the device being adapted to lock a movable element against movement relative to a stationary element, the device comprising:

an elongate deadbolt adapted to fit within the shackle of the padlock such that the deadbolt may translate along its longitudinal axis with respect to the padlock when the shackle is not in locking engagement with the body and is held substantially stationary with respect to the padlock when the shackle is in locking engagement with the body;

a keeper adapted to slibably receive the deadbolt;

a base plate having mounting holes therethrough;

a top plate having threaded holes extending partially therethrough; and bolts positionable through at least one of said movable and stationary elements and through the mounting holes for threaded engagement with the threaded holes, wherein at least one of said base plate and said top plate includes a first channel defining a first pathway adapted to slidably support said deadbolt to allow said deadbolt to translate along its longitudinal axis therein and includes a second channel defining a second pathway which intersects the first pathway and is adapted to receive the padlock while restricting motion of the padlock in directions parallel to the longitudinal axis of said deadbolt.

2. The device of claim 1 wherein both plates have channels defining the first and second pathways when said top plate and said base plate are joined as a unit.

3. The device of claim 1 wherein said deadbolt includes a notch for receiving the body of the padlock when the shackle is in locking engagement with the body of the padlock.

4. The device of claim 1, further comprising a roller bar disposed rotationally within said deadbolt.

* * * * *

UNITED STATES PATENT AND TRADEMARK OFFICE

CERTIFICATE OF CORRECTION

PATENT NO. : 4,883,294

DATED : November 28, 1989

INVENTOR(S) : Byron L. Goodspeed

It is certified that error appears in the above-identified patent and that said Letters Patent is hereby corrected as shown below:

Column 6, line 10, delete "slibably" and substitute --slidably--.

Signed and Sealed this

Sixteenth Day of April, 1991

*Attest:*

HARRY F. MANBECK, JR.

*Attesting Officer*

*Commissioner of Patents and Trademarks*